US008286595B2

(12) United States Patent
Cerney et al.

(10) Patent No.: US 8,286,595 B2
(45) Date of Patent: Oct. 16, 2012

(54) INTEGRATED SPLIT STREAM WATER COIL AIR HEATER AND ECONOMIZER (IWE)

(75) Inventors: Brian J. Cerney, Akron, OH (US); William R. Stirgwolt, Wadsworth, OH (US); Melvin J. Albrecht, Homeworth, OH (US); Kevin R. Thomas, Wadsworth, OH (US); George B. Brechun, Clinton, OH (US); John E. Monacelli, Uniontown, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 625 days.

(21) Appl. No.: 12/581,637

(22) Filed: Oct. 19, 2009

(65) Prior Publication Data

US 2010/0229805 A1 Sep. 16, 2010

Related U.S. Application Data

(60) Provisional application No. 61/158,774, filed on Mar. 10, 2009.

(51) Int. Cl.
*F22B 1/02* (2006.01)

(52) U.S. Cl. ..... 122/406.1; 122/414

(58) Field of Classification Search ..... 122/406.1, 122/406.3, 406.4, 412, 414, 426
See application file for complete search history.

(56) References Cited

U.S. PATENT DOCUMENTS 3,910,236 A * 10/1975 Merritt, Jr. ..... 122/421
4,318,366 A * 3/1982 Tompkins ..... 122/20 B
5,307,766 A * 5/1994 Pearce ..... 122/479.1
6,401,667 B2 * 6/2002 Liebig ..... 122/7 R

* cited by examiner

*Primary Examiner* — Gregory A Wilson
(74) *Attorney, Agent, or Firm* — Michael J. Seymour; Eric Marich

(57) ABSTRACT

An integrated water coil air heater and economizer arrangement for a boiler has a feedwater inlet for supplying feedwater to the boiler, and conduits and a valve for splitting the feedwater from the inlet into a first partial lower temperature, lower mass flow stream, and a second partial higher temperature, higher flow stream. A water coil air heater for passage of air to be heated for the boiler contains at least one heat transfer loop in heat transfer relationship with the air, the heat transfer loop of the water coil air heater being connected to receive the first partial stream. An economizer for passage of flue gas to be cooled for the boiler contains at least one heat transfer loop in heat transfer relationship with the flue gas, the heat transfer loop of the economizer being connected to the heat transfer loop of the water coil air heater for receiving the first partial stream from the water coil air heater. A mixing location downstream of the economizer receives and reunites the first and second partial streams and a conduit carries the second partial stream from the feedwater inlet to the to the mixing location.

2 Claims, 5 Drawing Sheets

INTEGRATED SPLIT STREAM WATER COIL AIR HEATER AND ECONOMIZER (IWE)

CROSS-REFERENCE TO RELATED APPLICATION

This application claims the benefit of U.S. Provisional Application Ser. No. 61/158,774, titled "IWE", filed Mar. 10, 2009, the disclosure of which is hereby incorporated by reference as though fully set forth herein.

FIELD AND BACKGROUND OF THE INVENTION

The present invention relates generally to the field of boilers and steam generators and, in particular, to air heaters for heating combustion air.

The tubular air heater is the main air heating mechanism with the water coil air-heater (WCAH) as a commonly used alternative. A tubular air heater or WCAH is currently used to heat combustion air to a specified operating temperature. The full flow of the boiler's feedwater is used as the heat transfer medium when using the WCAH as the heat source. As the air is heated, the temperature of the feedwater is lowered. The feedwater leaving the WCAH is then sent to an economizer where it is used to lower the temperature of the flue gas of the boiler. In certain cases a tubular air-heater (TAH) in conjunction with a WCAH is used to obtain a lower final exit gas temperature. As the stack gas temperature decreases the size of the TAH and WCAH increases. The size of the air-heaters will increase substantially as the gas temperature drops below 325 degrees F. The current technology is limited by the feedwater temperature, the stack gas temperature, and the required combustion air temperature.

U.S. Pat. No. 3,818,872 to Clayton, Jr. et al. discloses an arrangement for protecting, at low loads, furnace walls of a once-through steam generator having a recirculation loop, by bypassing some of the incoming feedwater flow around the economizer of the arrangement.

U.S. Pat. No. 4,160,009 to Hamabe discloses a boiler apparatus containing a denitrator which utilizes a catalyst and which is disposed in an optimum reaction temperature region for a catalyst of the denitrator. In order to control the temperature of the combustion gas in the optimum reaction temperature region, this region is adapted to communicate with a high temperature gas source or a low temperature gas source through a control valve.

U.S. Pat. No. 5,555,849 to Wiechard et al. discloses a gas temperature control system for the catalytic reduction of nitrogen oxide emissions where, in order to maintain a flue gas temperature up to the temperature required for the NOx catalytic reactor during low load operations, some feedwater flow bypasses the economizer of the system by supplying this partial flow to a bypass line to maintain a desired flue gas temperature to the catalytic reactor.

Published Patent Applications US 2007/0261646 and US 2007/0261647 to Albrecht et al., the disclosures of which are hereby incorporated by reference as though fully set forth herein, disclose a multiple pass economizer and method for SCR temperature control where maintaining a desired economizer outlet gas temperature across a range of boiler loads comprises a plurality of tubular configurations having surfaces that are in contact with the flue gas. Each tubular configuration may comprise a plurality of serpentine or stringer tubes arranged horizontally or vertically back and forth within the economizer, and each tubular configuration has a separate feedwater inlet.

Current technologies typically supply flue gas at or near the stack of the boiler system at well above 300 degrees F. It would be advantageous if a system were discovered that could economically lower this flue gas exit temperature.

SUMMARY OF THE INVENTION

It is an object of the present invention to obtain a lower final exit gas temperature for a boiler than what is economically possible with current technologies. The invention increases the driving force between the feedwater and the flue gas. This increased driving force improves heat transfer between the water and the flue gas, resulting in a much smaller heat transfer area than is needed when using traditional means.

To increase the driving force within the economizer the Log Mean Temperature Difference (LMTD) between the water and the flue gas is increased above what is possible with current technologies. Using current technology, under certain conditions the LMTD cannot be increased enough to allow for heat transfer to occur. The present invention solves that problem by increasing the LMTD of only a portion of the water flow going through the economizer while minimizing heat transfer occurring to the remaining water flow passing through the economizer.

According to the invention, an integrated water coil air heater (WCAH) and economizer (together hereinafter referred to or called an IWE) provides multiple water flow paths within the WCAH and economizer. The full flow of the feedwater enters the IWE as a single stream or multiple streams. Either outside the WCAH or once within the WCAH section of the IWE, the feedwater flow is split into two or more streams (split stream WCAH). The flow is biased between the split streams based on desired operating conditions.

The various novel features which characterize the invention are pointed out with particularity in the claims annexed to and forming a part of this disclosure. For a better understanding of the invention, its operating advantages and specific benefits attained by its uses, reference is made to the accompanying drawings and descriptive matter which illustrate preferred embodiments of the invention.

DESCRIPTION OF THE PREFERRED EMBODIMENTS

Figure 1:
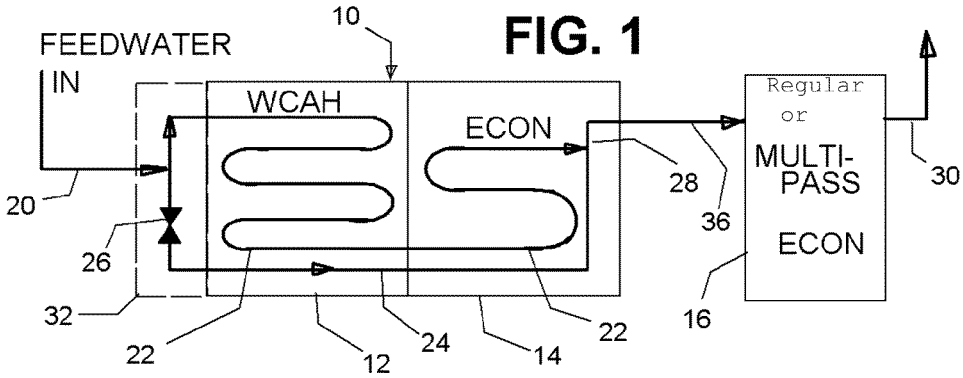
FIG. 1 is a schematic diagram of one embodiment of the IWE of the present invention.

Referring now to the drawings, wherein like reference numerals are used to refer to the same or functionally similar elements throughout the several drawings, FIG. 1 shows an integrated water coil air heater or WCAH 12 and economizer or ECON 14 that together form the IWE 10 of the invention. The IWE can also be used with a multi-pass economizer 16 of the type disclosed in Published Patent Applications US 2007/0261646 and US 2007/0261647, which may receive the output water from economizer 14 of the IWE 10.

Description of the Apparatus

The total input of feedwater at inlet 20, is divided by split means such as conduits and one or more valves, into a first partial high temperature, lower mass flow stream 22, and a second partial higher temperature, higher mass flow stream 24. The first partial stream 22 passed through at least one heat transfer loop in the WCAH 12 that contains a major portion of the heat transfer surface of the WCAH 12, and is used to increase the LMTD between the water and the economizer gas. This is done by using only a portion of the total water flow to heat the air passing the WCAH 12. This results in a much lower water temperature entering the economizer 14. The second partial stream 24 travels along a conduit and has minimal heat transfer surface and is used to move the majority of the water. Both streams 22 and 24 pass through the economizer 14 for simplicity of construction, so that both streams have some heat transfer effect to allow for biasing of the flow and thus better control, and to minimize thermal shock when the streams are reunited. The amount of flow in each stream is determined by the set point of a valve 26.

The water in each stream remains split throughout the WCAH section 12 and the streams enter the economizer section 14 as two separate streams (split stream). The water enters the economizer section of the IWE 10 as a lower temperature, lower mass flow stream 22, and a higher temperature, high flow stream 24. The streams remain split throughout the economizer section 14 (split stream economizer). The low temperature low flow stream 22 is used as the major heat transfer medium with the flue gas. This stream 22 travels through the majority of the heat transfer surface in both the WCAH 12 and ECON 14. The high temperature, high flow stream 24 has minimal heat transfer surface to reduce heat transfer with the flue gas.

Once both streams 22 and 24 have passed completely or mostly through the economizer section 14, they are combined in the mixing section 28 of the IWE 10, that is either inside, or outside, but is at least near the downstream end of the economizer 14. This combined stream then exits the IWE and is either sent at 30 through the steam drum of the boiler (not shown) or from the output 36 of economizer 14, through a non-split stream economizer or multi-pass economizer 16, for further heat transfer work.

As shown by the dotted line 32 enclosing the upstream ends of streams 22 and 24 and the valve 26, the split in the feedwater may occur within the water coil air heater enclosure or WCAH 12.

Figure 2:
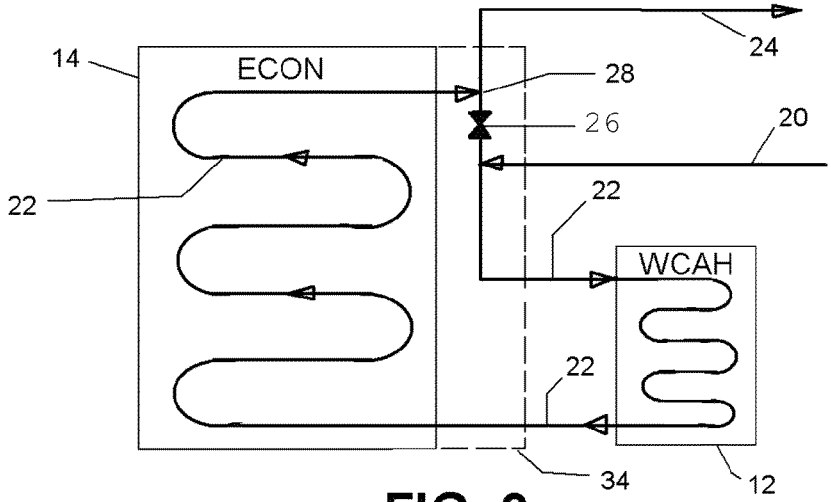
FIG. 2 is a schematic diagram of another embodiment of the IWE of the present invention.

Another embodiment of the IWE is illustrated in FIG. 2 where the split in streams 22 and 24, the valve 26 and the mixing section 28, may all be upstream of the WCAH 12 or, as shown by dotted line 34, both upstream of the WCAH 12 and inside the economizer 14.

Figure 4:
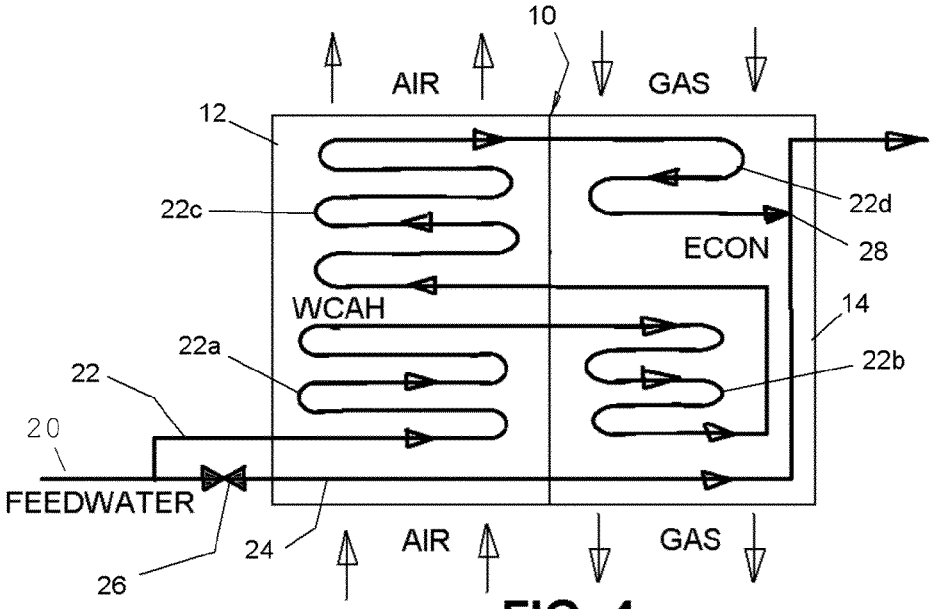
FIG. 4 is a schematic diagram of a still further embodiment of the IWE of the present invention.

FIG. 4 illustrates a still further embodiment of the IWE where the lower temperature, lower mass flow stream 22 first passed a heat exchange loop 22*a* in WCAH 12 that is being supplied by an upward flow of combustion air and therefore cooled. The stream 22 then enters a second heat exchange loop 22*b* in the economizer 14 to be heated by flue gas passing downwardly in the economizer, then to a third heat transfer loop 22*c* back in WCAH 12 for giving up heat to the air and coming to about the air temperature, and then once again to a fourth loop 22*d* for again being heated by the flue gas before reuniting with the higher temperature, higher flow stream 24 at mixing section 28.

The upstream split in feedwater 20 into streams 22 and 24 and valve 26 are shown outside WCAH 12 in FIG. 4 but they may alternatively be inside the WCAH 12.

Figure 3:
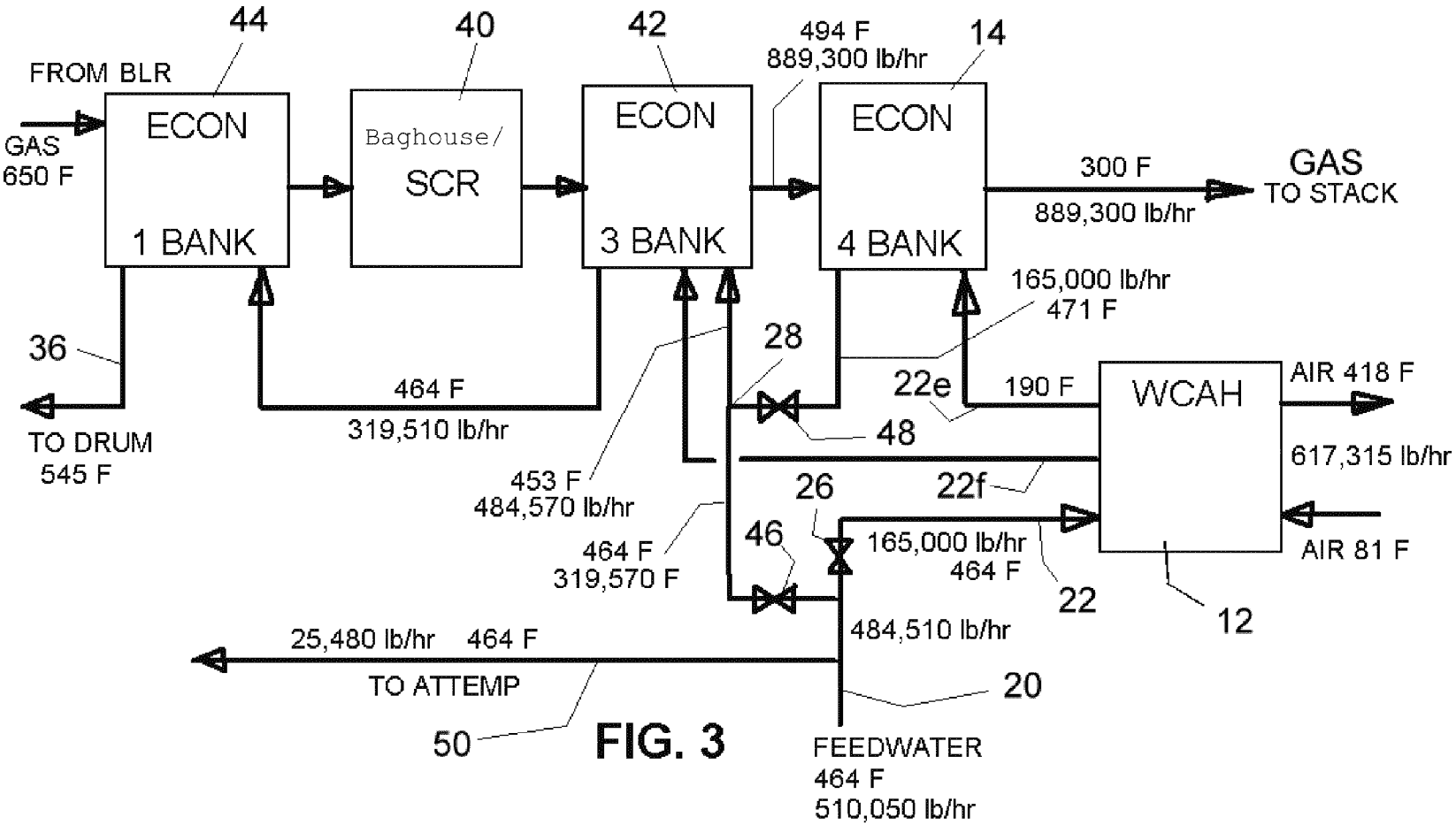
FIG. 3 is a block diagram of a still further embodiment of the IWE of the present invention which has multiple separate economizer banks.

FIG. 3 is a block diagram of another embodiment of the invention that includes exemplary flow rates and temperatures as well as illustrates how a Selective Catalytic Reduction unit of Nitrogen Oxides or SCR 40 can be incorporated into the invention. The economizer 14 of the IWE of the invention, which may be a 4 bank economizer, is downstream of the SCR 40 and receives the lower temperature, lower mass flow stream 22*e* from WCAH 12. Alternatively, part or all of the lower temperature, lower mass flow stream 22*f* from WCAH 12 is supplied to a second 3 bank economizer 42, which also receives all of the high temperature, high flow rate feedwater stream 24 after it has been reunited with the stream 22*e* leaving economizer 14 at mixing section 28. Valves 26, 46 and 48 are set to control the streams 22 and 24 and their distribution amount to the economizers 14 and 42. Some feedwater may also be tapped at 50 to be supplied to an attemperator (not shown). The recombined feedwater flow from economizer 42 is then supplied to a 1 bank economizer 44 that is upstream of the SCR, before going to the steam drum at 36.

FIG. 3 also illustrates the counter current flue gas flow first into economizer 44 at 650 F, then through the SCR 40 and on to the economizer 42 and, at a flow of 889,300 lb/hr and 494 F, to economizer 14 of the IWE, and finally, at an acceptable stack gas temperature of 300 F, the full flue gas flow is discharged. Combustion air at 617,315 lb/hr and 81 F enters the WCAH 12, is heated, and then leaves at a temperature of 418 F. As noted above, temperatures and flow rated for the feedwater streams are shown in FIG. 3.

Figure 5:
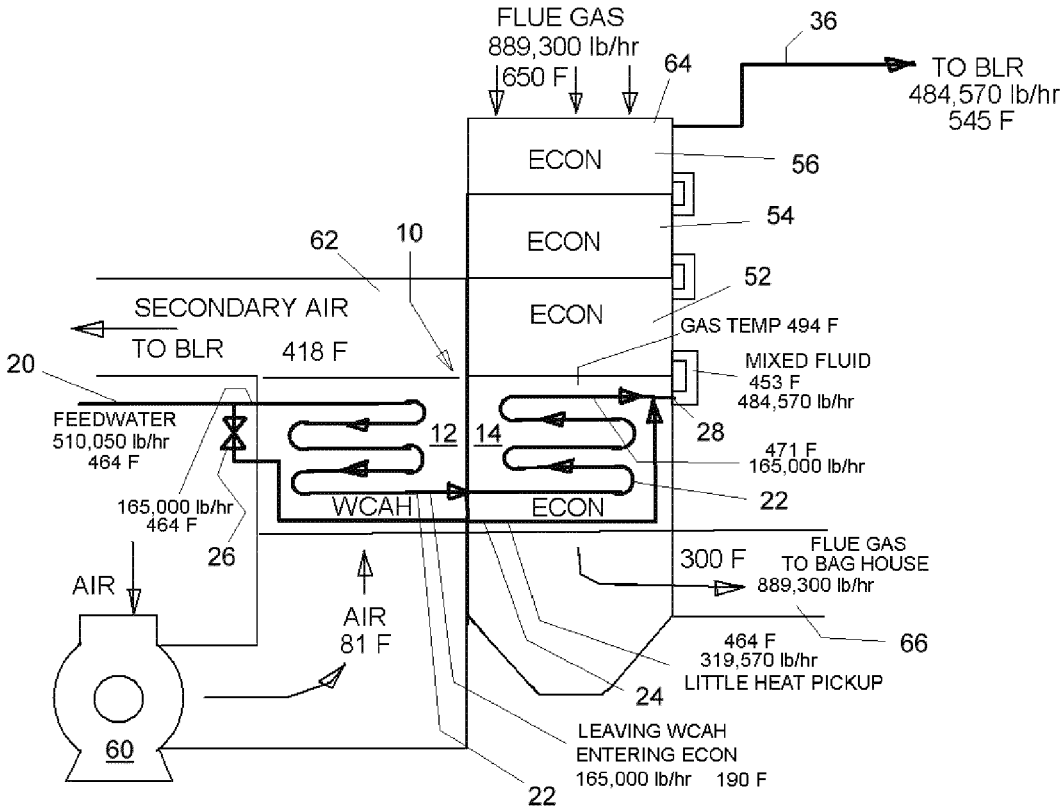
FIG. 5 is a schematic diagram of a furnace section of a boiler containing the IWE of the present invention according to FIG. 1.
Figure 6:
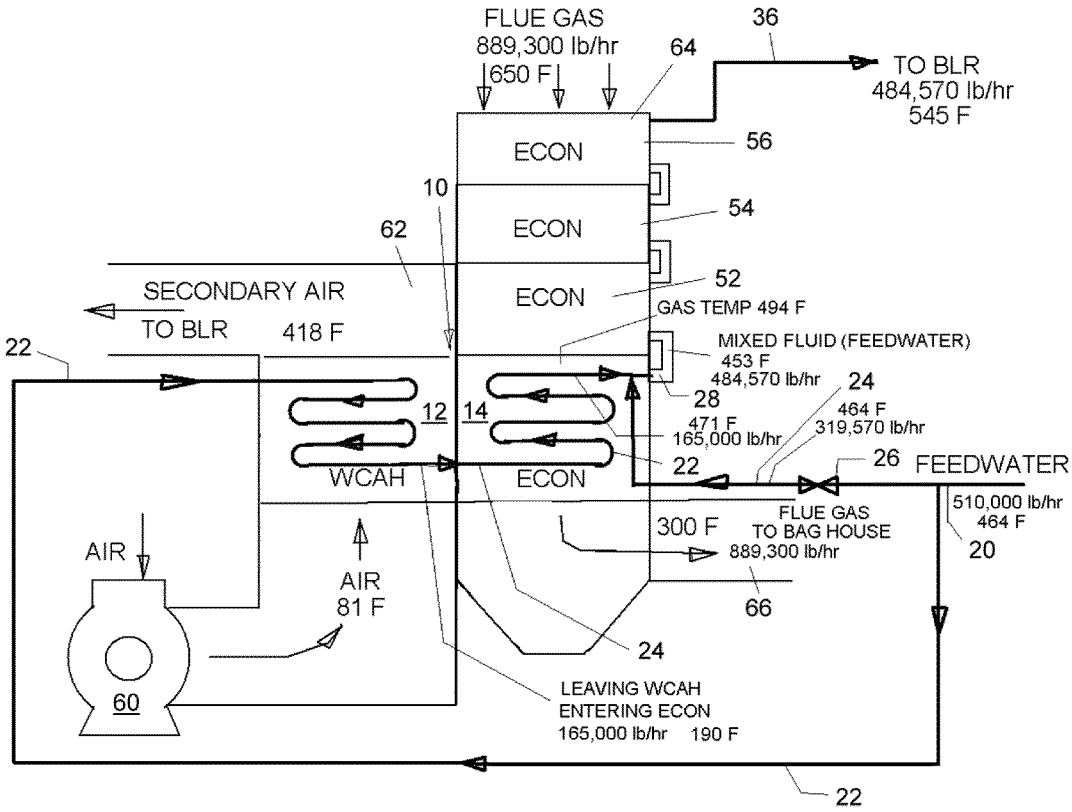
FIG. 6 is a schematic diagram of a furnace section of a boiler similar to FIG. 5 but containing the IWE of a further embodiment of the present invention.
Figure 7:
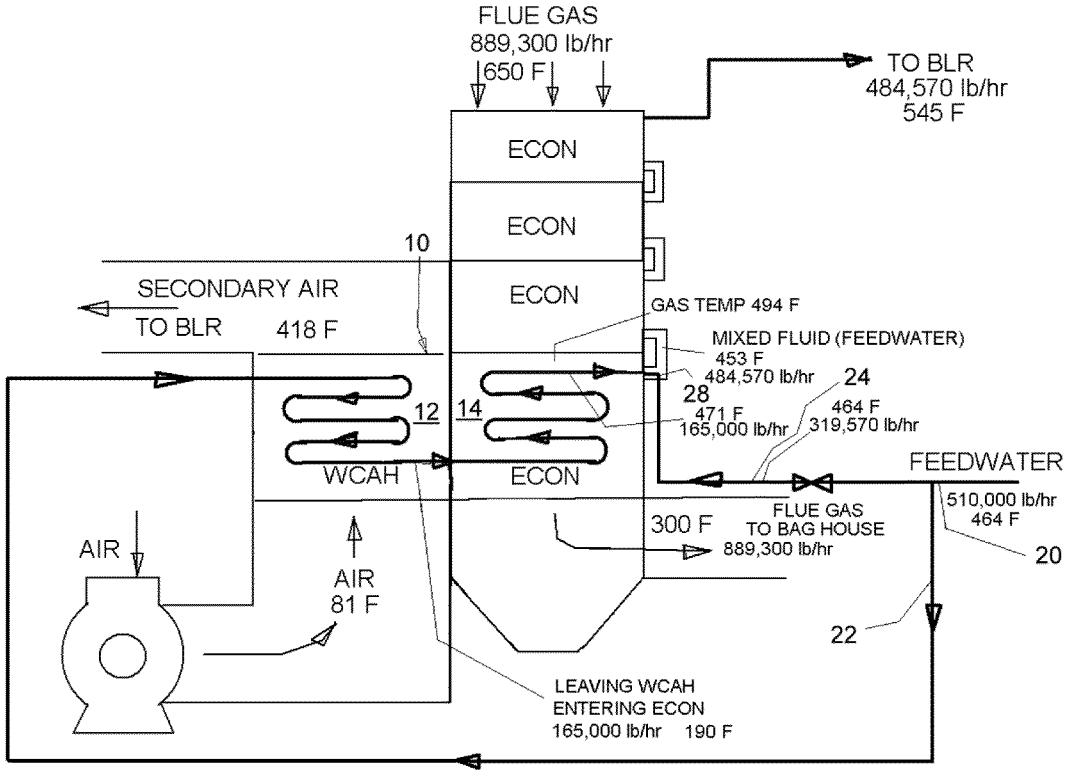
FIG. 7 is a schematic diagram of a furnace section of a boiler similar to FIG. 5 but containing the IWE of a still further embodiment of the present invention.

FIGS. 5, 6 and 7 illustrate embodiments of the IWE of the present invention in boiler furnace sections and also show exemplary conditions for operation of the invention.

In FIG. 5, the IWE 10 with WCAH 12 and ECON 14 receive the feedwater streams 22 and 24, split by valve 26 from the feedwater inlet 20, and the feedwater streams are reunited and mixed at 28 before being supplied to a second economizer 52 where additional heat from flue gas inlet 64 at the top of the furnace section at 650 F, is taken up by the water. The combined feedwater flow is then supplied in series to a third economizer 54 and then a fourth economizer 56, before being discharged at 36 and at 545 F to return to other sections of the boiler.

Flue gas, now cooled to 300 F, is supplied at outlet 66 to the furnace stack (not shown).

Meanwhile combustion air is supplied by a blower 60 to the WCAH 12 at 81 F, where it is heated to 418 F before being supplied as secondary air at 62, by feedwater supplied at inlet 20, at 464 F.

A similar apparatus to that of FIG. 5 is shown in FIG. 6 where, however, the feedwater 20 is split so that one partial stream 22 goes through the WCAH 12 and the discharge from WCAH 12 is supplied to economizer 14 where it is reunited with the other partial feedwater stream 24 from valve 26, so that all the feedwater is heated by flue gas passing through the economizer 14.

In the embodiment of FIG. 7, which is similar to that of FIG. 6, except that only one stream 22 of feedwater passed in the economizer 14, while the other stream 24 that had been split from the total feedwater inlet 20, is reunited with stream 22 outside the economizer 14 at 28. In this way only a portion of the feedwater, i.e. stream 22, is cooled in the WCAH 12.

Further Description of the Process

Feedwater Flow Path:

1. Feedwater (20) enters boiler boundary at full flow and temperature.
2. The feedwater enters the IWE in the biasing section of the split stream WCAH (12) where it is split into two streams (22, 24). Both streams remain separate throughout the IWE (10).
3. The first stream (22) is passed through the majority of the WCAH's tubes (heating surface).
4. The second stream (24) is sent through a single stream with minimal heating surface.
5. The majority of the heat transfer occurs in the first stream which lowers the temperature of the water in that stream. Minimal heat transfer occurs in the second stream as it passes through the WCAH section.
6. Both streams exit the WCAH section and enter the split stream economizer section.
7. The first stream passes through the majority of the economizer tubes (heating surface). This stream does the majority of the cooling of the gases.
8. The second stream passes through a single large tube with minimal heat transfer surface.
9. After both streams pass through the economizer section of the IWE, they enter a mixing section (28).
10. Within the mixing section the two streams are mixed together and then exit the IWE (10).
11. After the water leaves the IWE it is sent to the drum or other economizer section(s) as a single flow stream.

Flue Gas Flow Path:

1. The flue gas exits the boiler and passes through other heat transfer surface.
2. The flue gas then enters into the economizer section of the IWE.
3. The gas passes over both streams with the majority of the heat transfer occurring in the low temperature low flow heating surface.
4. The flue gas then exits the IWE.

Control of Feedwater Split

The control methodology for setting of valve 26, and therefore the relative feedwater amounts in the first and second partial streams 22 and 24, is similar to that of Published Patent Applications US 2007/0261646 and US 2007/0261647. Under this methodology an algorithm is developed to quantify theoretical steady state conditions, wherein mass flow rates are utilized as inputs. The algorithm is necessary as steady state can take upwards of an hour or more to reach, thus making real time temperature measurements downstream of the economizer potentially misleading in the event steady state has not be reached. Once steady state is reached the algorithms can be "trimmed" (i.e. proportionally adjusted) to make up for actual vs. theoretical operational differences. The algorithm used is dependent upon the actual size of the equipment and mass flow rates available.

While specific embodiments of this invention have been shown and described in detail to illustrate the application and principles of the invention, it will be understood that it is not intended that the present invention be limited thereto and that the invention may be embodied otherwise without departing from such principles. For example, the present invention may be applied to new construction involving boilers or steam generators, or to the replacement, repair or modification of existing boilers or steam generators. In some embodiments of the invention, certain features of the invention may sometimes be used to advantage without a corresponding use of the other features. Accordingly, all such changes and embodiments properly fall within the scope of the following claims (including any and all equivalents).

What is claimed is:

1. An integrated water coil air heater and economizer arrangement for improving log mean temperature difference for a boiler, comprising:

a feedwater inlet for supplying feedwater to the boiler;

split means for splitting the feedwater from the inlet into a first partial high temperature, lower mass flow stream, and a second partial higher temperature, higher flow stream;

a water coil air heater for passage of air to be heated for the boiler, the water coil air heater containing at least one heat transfer loop in heat transfer relationship with the air, the heat transfer loop of the water coil air heater being connected to the split means for receiving the first partial stream;

an economizer for passage of flue gas to be cooled for the boiler, the economizer containing at least one heat transfer loop in heat transfer relationship with the flue gas, the heat transfer loop of the economizer being connected to the heat transfer loop of the water coil air heater for receiving the first partial stream from the water coil air heater;

mixing means near a downstream end of the economizer for receiving and reuniting the first and second partial streams; and a conduit connected between the split means and the mixing means for passing the second partial stream to the mixing means.

2. A method for improving log mean temperature difference for an economizer of a boiler, comprising:

supplying a feedwater stream to the boiler;

splitting the feedwater stream into a first partial high temperature, lower mass flow stream, and a second partial higher temperature, higher flow stream;

supplying the first partial stream to a water coil air heater for passage of air to be heated for the boiler, the water coil air heater containing at least one heat transfer loop in heat transfer relationship with the air, the first partial stream being passed through the heat transfer loop of the water coil air heater;

supplying the first partial stream after it has passed through the heat transfer loop of the water coil air heater, to an economizer for passage of flue gas to be cooled for the boiler, the economizer containing at least one heat transfer loop in heat transfer relationship with the flue gas, the first partial stream from the water coil air heater being passed through the heat transfer loop of the economizer;

conducting the second partial stream to a downstream end of the economizer; and reuniting the first and second partial streams near the downstream end of the economizer.

* * * * *